US009890343B2

(12) United States Patent
Ettl et al.

(10) Patent No.: US 9,890,343 B2
(45) Date of Patent: Feb. 13, 2018

(54) PROCESS AND BIOFILTER SYSTEM FOR H2S REMOVAL FROM A H2S CONTAMINATED ENERGY PRODUCTION GAS STREAM CONTAINING METHANE AND USE OF SUCH A BIOFILTER SYSTEM

(71) Applicant: YARA INTERNATIONAL ASA, Oslo (NO)

(72) Inventors: Marina Ettl, Alpen-Veen (DE); Wolfram Franke, Porsgrunn (NO); Werner Van Borm, Zaventem (BE)

(73) Assignee: YARA INTERNATIONAL ASA, Oslo (NO)

( * ) Notice: Subject to any disclaimer, the term of this patent is extended or adjusted under 35 U.S.C. 154(b) by 18 days.

(21) Appl. No.: 14/916,614

(22) PCT Filed: Sep. 18, 2014

(86) PCT No.: PCT/EP2014/069866
§ 371 (c)(1),
(2) Date: Mar. 4, 2016

(87) PCT Pub. No.: WO2015/040100
PCT Pub. Date: Mar. 26, 2015

(65) Prior Publication Data

US 2016/0200996 A1 Jul. 14, 2016

(30) Foreign Application Priority Data

Sep. 18, 2013 (NO) ..... 20131255

(51) Int. Cl.
*A61L 9/01* (2006.01)
*C10L 3/10* (2006.01)

(52) U.S. Cl.
CPC ..... *C10L 3/103* (2013.01); *C10L 2290/141* (2013.01); *C10L 2290/26* (2013.01); *C10L 2290/547* (2013.01)

(58) Field of Classification Search
CPC ..... C10L 2290/141; C10L 2290/26; C10L 2290/547; C10L 2290/544; C10L 3/103
See application file for complete search history.

(56) References Cited

U.S. PATENT DOCUMENTS 4,760,027 A 7/1988 Sublette
4,911,843 A * 3/1990 Hunniford ..... C02F 1/72 210/610

(Continued)

FOREIGN PATENT DOCUMENTS

EP 0 186 925 A1 7/1986
EP 0218958 A2 4/1987

(Continued)

OTHER PUBLICATIONS

PCT International Search Report and Written Opinion dated Dec. 8, 2014 for PCT International Patent Application No. PCT/EP2014/069866, 9 pages.

(Continued)

*Primary Examiner* — Nathan A Bowers
*Assistant Examiner* — Lydia Edwards
(74) *Attorney, Agent, or Firm* — Amster, Rothstein & Ebenstein LLP

(57) ABSTRACT

The invention relates to a process and a biofilter system (10) for removing $H_2S$ from a $H_2S$ contaminated energy production gas stream containing methane. The aqueous biofilter system comprises a biofilter (6) having biofilter support material constituting a biofilter bed supporting a humidified biofilm having microorganisms that are capable of oxidizing $H_2S$. The process comprises the steps of contacting the $H_2S$ (Continued)

contaminated energy production gas stream with the microorganisms of the humidified biofilm, and oxidation of at least part of the $H_2S$ in the $H_2S$ contaminated energy production gas stream by the microorganisms, resulting in a $H_2S$ depleted energy production gas stream, wherein the process further comprises the step of adding an aqueous nitrate solution to the $H_2S$ contaminated energy production gas stream prior to being contacted with the microorganisms, enabling the microorganisms to oxidize the $H_2S$ under anoxic conditions. The invention furthermore relates to the use of such a biofilter system (10) in the removal of $H_2S$ from a $H_2S$ contaminated energy production gas stream containing methane.

15 Claims, 1 Drawing Sheet

(56) References Cited

U.S. PATENT DOCUMENTS 6,221,652 B1 * 4/2001 Janssen ..... B01D 53/84
210/610
7,276,366 B2 * 10/2007 Parker ..... B01D 53/84
422/105

FOREIGN PATENT DOCUMENTS

| | | | |
|---|---|---|---|
| EP | 0 845 288 | A1 | 6/1998 |
| FR | 2962051 | A1 | 1/2012 |
| WO | 2008131034 | A2 | 10/2008 |

OTHER PUBLICATIONS

Norwegian Search Report for Norwegian Patent No. 20131255, 3 pages, dated Feb. 11, 2014.

Soreanu G et al., entitled "Study on the Performance of an Anoxic Biotrickling Filter for the Removal of Hydrogen Sulphide from Biogas," Water Qual. Res. J. Can., 2008, vol. 43, No. 2/3, 93-102.

Montebello, A M et al., entitled "Simultaneous methylmercaptan and hydrogen sulfide removal in the desulfurization of biogas in aerobic and anoxic biotrickling filters," Chemical Engineering Journal 200-202 (2012) 237-246.

Fernández M et al., entitled "Hydrogen sulphide removal from biogas by an anoxic biotrickling filter packed with Pall rings," Chemical Engineering Journal 225 (2013) 456-463.

* cited by examiner

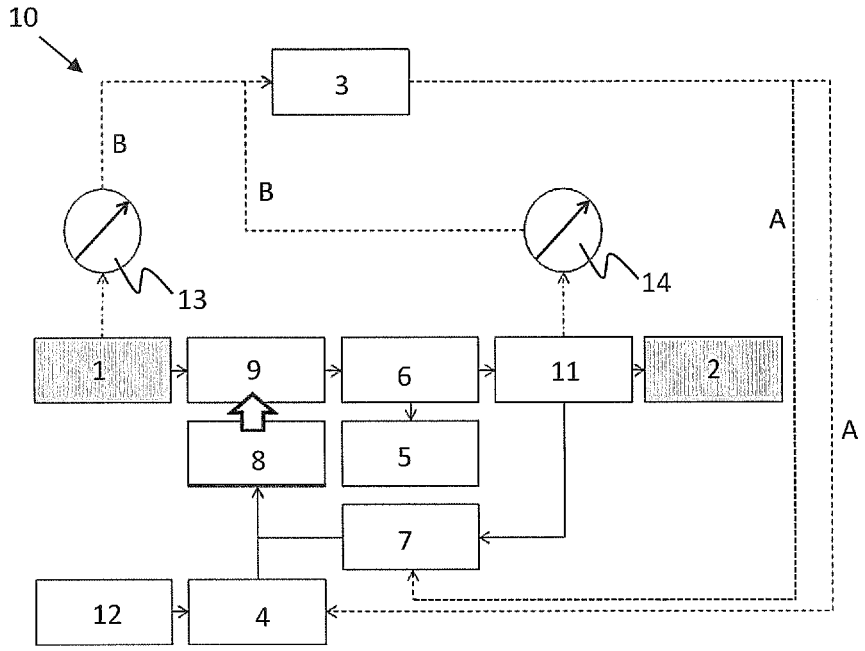
10
3
B
B
A
13
14
1
9
6
11
2
8
5
7
12
4
A

PROCESS AND BIOFILTER SYSTEM FOR H2S REMOVAL FROM A H2S CONTAMINATED ENERGY PRODUCTION GAS STREAM CONTAINING METHANE AND USE OF SUCH A BIOFILTER SYSTEM

CROSS-REFERENCE TO RELATED APPLICATIONS

This application is a U.S. national stage entry under 35 U.S.C. §371 of PCT International Patent Application No. PCT/EP2014/069866, filed Sep. 18, 2014, which claims priority to Norwegian Patent Application No. 20131255, filed Sep. 18, 2013, the contents of which are incorporated herein by reference in their entirety.

FIELD OF THE INVENTION

The invention relates to a process for removing $H_2S$ (hydrogen sulphide) from a $H_2S$ contaminated energy production gas stream containing methane, using an aqueous biofilter system comprising a biofilter having biofilter support material constituting a biofilter bed supporting a biofilm having microorganisms that are capable of oxidizing $H_2S$. The process therewith comprises the steps of contacting the $H_2S$ contaminated energy production gas stream with the microorganisms and oxidation of at least part of the $H_2S$ in the $H_2S$ contaminated energy production gas stream by the microorganisms, resulting in a $H_2S$ depleted energy production gas stream.

Examples of such $H_2S$ contaminated energy production gases containing methane are biogas, natural gas or shale gas, these examples however not being limitative.

Biogas is a mixture of gases that is produced by the biological breakdown of organic matter in the absence of oxygen. Biogas is produced through the anaerobic digestion or fermentation of biodegradable material such as biosolids, manures, sewage, municipal waste, green waste, plant material and energy crops. Biogas is comprised primarily of methane and carbon dioxide.

Natural gas is a naturally occurring hydrocarbon gas mixture consisting primarily of methane. It commonly furthermore includes varying amounts of other higher alkanes and lesser percentages of carbon dioxide, nitrogen and hydrogen sulphide.

Shale gas is a natural gas that can be found trapped within shale formations. Shale gas is extracted from fine-grained sedimentary rocks known as shale that can be rich sources of petroleum and natural gas. This gas is trapped within shale formations which are extracted by technology-oriented processes.

When biofilter systems are applied as air or other gas stream treatment systems, these biofilter systems use microorganisms to remove impurities or contaminants in the air or gas stream. In a typical biofilter system, an air or gas stream is urged to flow through a moist, biologically active, packed biofilter bed consisting of biofilter support material containing microorganisms that are immobilized on the biofilter support material and forming a biofilm on the biofilter support material.

The process underlying the operation of the biofilter is a three-step process. In a first step, a phase transfer occurs wherein impurities in the air/gas stream such as $H_2S$ are transferred from the gaseous phase to the liquid phase, i.e. to the aqueous solution used to humidify the biofilm. This first step is followed by a second, adsorption step wherein, once in the liquid phase, the impurities are absorbed to the biofilter support material of the biofilter bed. Finally, in a biodegradation step, the impurities are biodegraded by the microorganisms of the biofilm.

The invention furthermore relates to an aqueous biofilter system arranged to remove $H_2S$ from a $H_2S$ contaminated energy production gas stream containing methane.

The aqueous biofilter system therewith comprises a biofilter having biofilter support material constituting a biofilter bed supporting a biofilm having microorganisms capable of oxidizing $H_2S$, the biofilm being arranged to be contacted with the energy production gas stream and the microorganisms being arranged to remove at least part of the $H_2S$ out of the energy production gas stream resulting in a $H_2S$ depleted energy production gas stream.

The invention also relates to the use of an aqueous biofilter system according to the invention for removing $H_2S$ from a $H_2S$ contaminated energy production gas stream containing methane.

BACKGROUND OF THE INVENTION

Since energy production gas such as biogas is produced with the purpose of energetic use, the gas quality needs to meet the technical requirements of combustion engines. Impurities (or contaminants) such as $H_2S$ are found in concentrations between 1,000 to 10,000, while combustion systems require typically concentrations lower than 200 ppm of $H_2S$.

The most common technologies to remove $H_2S$ from biogas are processes that are downstream of the production step. Often physio-chemical processes as wet gas oxidation are used. However, these have high investment and operational costs.

Biological gas treatment processes are based on microbial digestion of contaminants in the biological gas. Established systems for this purpose are bioscrubbers, biotrickling filters and biofilters. In general, biofiltration uses naturally occurring microorganisms to biologically break down odors, solvents and other VOCs (volatile organic compounds) present in air streams such as waste air streams or gas streams such as energy production gas streams, into carbon dioxide and waste water. It is a completely natural process that does not use chemicals or produce waste. Biofiltration is a reliable and cost-effective way to eliminate odors, VOCs and $H_2S$ at manufacturing, municipal and processing facilities. The microorganisms which reside on the surface of the biofilter support media forming a biofilm use the pollutants as a food source. A cleaned air gas stream is then discharged to the environment. Biofiltration systems need to be run without strong variations in turnover of gas and contaminants as the microbial community reacts slowly on changes and has to be balanced.

The use of biofilter systems in removal of contaminants such as, amongst others, $H_2S$ from air and gas streams has already been known for a long time. In U.S. Pat. No. 4,086,167 for instance, already dating from 1978, a biofilter for treatment of waste waters and gases, comprising a bed of coniferous tree barking residue containing microorganisms, is disclosed.

Since that time, the technology of biofiltration has been developed according to VDI guideline 3477 describing today's standards. The latest developments in biofiltration technology have amongst others been summarized in the book titled "Air pollution prevention and control: bioreactors and bioenergy", edited by Christian Kennes and Maria C. Veiga, published 2013 by John Wiley & Sons, Ltd.

Z. Shareefdeen and A. Singh (Ed.) "Biotechnology for Odor Air Pollution Control", Springer-Verlag (2005) have in Table 8.2, page 171 given an overview and comparison of different technologies for waste gas treatment. These are three different processes where the present invention is of the biofilter type which is a "dry" process. Biotrickling filters are operated with a wet through biofilm and in a bioscrubber process the biofilm is immersed in liquid.

TABLE B2

Comparison of major technologies for waste gas treatment
8 Bioscrubber Technology 171

| Characteristics | Biofilter | Biotrickling filter | Bioscrubber |
|---|---|---|---|
| Reactor design | Single reactor | Single reactor | Two reactors |
| Capital and operating cost | Low | Comparatively higher | Comparatively higher |
| Carrier | Organic or synthetic | Synthetic | No carrier |
| Area | Large area required | Compact equipment | Smaller volume of equipment |
| Mobile phase | Gas | Liquid | Liquid |
| Surface area | High | Low | Low |
| Process control | Limited process control | Limited process control | Good process control |
| Gas flow rate | 100-150 $m^3$ $m^{-2}$ $h^{-1}$ | | 3,000-4,000 $m^3$ $m^{-2}$ $h^{-1}$ |
| Operation | Easy startup and operation | Relatively complicated startup procedure | Relatively complicated startup procedure |
| Operational stability | Channeling of airflow common | Channeling of water is common | High operational stability |
| Pressure drop | Medium to high | Medium to high | Low |
| Target compound conc. | <1 $gm^{-3}$ | <0.5 $gm^{-3}$ | <5 $gm^{-3}$ |
| Suitable for compounds with Henry coefficient | <1 | <0.1 | <0.01 |
| Nutrients | Nutrients cannot be added | Ability to add and control nutrients | Ability to add and control nutrients |
| Biomass | Fixed biomass | Fixed biomass | Suspended biomass |
| Clogging of packing | Clogging problem | Clogging problem | No clogging problem |
| Excess sludge | No such problems | Disposal of excess sludge required | Disposal of excess sludge required |

Also, several more recent patent documents describe the use of biofilter systems in the removal of contaminants out of air and gas streams, more specifically in the removal of $H_2S$, and more specifically out of $H_2S$ contaminated energy production gas streams containing methane.

In WO 2005/037403 for instance, a biofilter media is disclosed including grains having a hydrophilic nucleus and a hydrophobic coating including microorganisms and a metallic agent that both assist in the breakdown of amongst others $H_2S$. The biofilter media is housed in a biofilter system including elements for the irrigation and humidification of the air stream of the biofilter media by steam or spray to ensure that the biofilter media is operating at appropriate temperature and moisture levels to avoid build-up of biomass or chemical deposits. The nutrients required for microorganism viability are therewith present in the hydrophobic coating, this preferably as a blend of trace elements. The disadvantage of the system as disclosed in WO 2005/037403 for providing the nutrients required for microorganisms viability in the hydrophobic coating is that the nutrients are not renewed once the nutrients as present in the hydrophobic coating are exhausted.

In WO 2005/005605, a system for removing $H_2S$ from methane ($CH_4$) is disclosed which uses aerobic microorganisms to remove the hydrogen sulphide from the gas stream and oxidize it back to sulphate, which will then combine with water to form sulphuric acid. The system includes providing at least one biofilter cartridge that functions to sustain microbial activity which will function to consume $H_2S$ contained in a stream of methane gas.

Since aerobic microorganisms need an electron acceptor to be able to oxidize $H_2S$, and in a methane gas stream, no such electron acceptors are present in sufficient amounts, air has to be injected in the biofilter cartridge as described above in order to provide oxygen to be used as the electron acceptor. As air is injected, also plenty of nitrogen is introduced into the gas stream, i.e. around 78%, diluting the methane gas and disturbing the quality thereof.

Also in US 2012/0264197, a process for removing hydrogen sulphide from a raw natural gas stream such as biogas from landfills or controlled anaerobic digestion is disclosed using oxygen, commonly in the form of air, to remove the H2S out of the raw natural gas stream. In order to solve the abovementioned problem, the natural gas stream is therewith passed through a separation unit to form on the one hand, a product stream comprising a high concentration of methane and on the other hand, a low pressure tail gas containing $H_2S$ which is passed through a biofilter including bacteria that degrades the $H_2S$ to sulphur and sulphate compounds that are washed from the biofilter.

Such a process however requires more costly equipment.

Therefore, there exists the need to provide a simple and cost effective but at the same time efficient way to remove $H_2S$ from a $H_2S$ contaminated energy production gas stream containing methane using a biofilter system, furthermore maintaining the quality of the treated ($H_2S$ depleted) energy production gas stream.

SUMMARY OF THE INVENTION

According to a first aspect of the invention, a process is provided for removing $H_2S$ from a $H_2S$ contaminated energy production gas stream containing methane, using an aqueous biofilter system, comprising a biofilm having biofilter support material constituting a biofilter bed and supporting a humidified biofilm having microorganisms that are capable of oxidizing $H_2S$, wherein the process comprises the steps of

- contacting the $H_2S$ contaminated energy production gas stream with the microorganisms of the humidified biofilm, and
- oxidation of at least part of the $H_2S$ in the $H_2S$ contaminated energy production gas stream by the microorganisms, resulting in a $H_2S$ depleted energy production gas stream, wherein the process further comprises the steps of adding an aqueous nitrate solution to the $H_2S$ contaminated energy production gas stream prior to being contacted with the microorganisms, enabling the microorganisms to oxidize the $H_2S$ under anoxic conditions.

The term "anoxic" means "nearly in absence of or in the presence of a very low amount of oxygen", so that the oxidation reduction potential of the subsequent reaction ranges between 800 mV and −200 mV, preferably is about 400 mV.

For anoxic $H_2S$ oxidation, about 2 g $NO_3$— is needed to oxidize 1 g $H_2S$ according to the following chemical reaction:

$$5H_2S+8NO_3^- \rightarrow 5SO_4^{2-}+4N_2+4H_2O+2H^+$$

The abovementioned single step process using a biofilter system provides a simple and cost effective way to obtain a $H_2S$ depleted energy production gas stream. Furthermore, by oxidizing the $H_2S$ under anoxic conditions, the inflow of nitrogen in the biofilter system is limited, through which the quality of the energy production gas stream after treatment with the biofilter is maintained.

In the biofilter support material, the microorganisms generate inert agents as well as other substances, i.e. mainly elemental sulphur, insoluble sulphate salts, formed by the microorganisms through the anoxic oxidation of the $H_2S$ such as calcium sulphate and/or organic sulphur compounds that precipitate in the biofilter support material. In order to prevent clogging of these inert precipitating agents and other substances, the nitrate solution comprises a chelating agent.

For prevention of clogging of calcium sulphate precipitation, this chelating agent preferably comprises ethylene diamine tetra acetic acid (EDTA).

The nitrate solution that is used to enable the microorganisms to anoxically oxidize $H_2S$ preferably comprises a calcium nitrate solution.

In an advantageous embodiment of a process according to the invention, the process comprises the step of recirculating part of the $H_2S$ depleted energy gas stream to the biofilter and adding to the recirculated energy production gas stream a nutrient solution prior to being contacted with the microorganisms of the biofilm.

This recirculation is beneficial for the biofilter system since the $H_2S$ depleted energy gas stream, once passed through the biofilter support material, contains microorganisms, originating from the biofilm, and as a result of the recirculation, these microorganisms will also be reintroduced into the inlet of the biofilter system again. This increases the oxidation activity of the microorganisms in the entry area of the biofilter system, what would not be the case in the case of absence of recirculation.

In a more advantageous embodiment of a process according to the invention, the process comprises the step of automatically adjusting the dosage of the nutrient solution, added to the $H_2S$ contaminated energy production gas stream, in relation to the $H_2S$ content in the $H_2S$ contaminated energy production gas stream at an inlet of the biofilter system.

In a favourable embodiment of a process according to the invention, the biofilm is humidified by means of the energy production gas stream which has been pre-humidified prior to contacting the biofilm.

According to a further aspect of the invention, an aqueous biofilter system is provided that is arranged to remove $H_2S$ from an $H_2S$ contaminated energy production gas stream containing methane, the aqueous biofilter system comprising a biofilter having biofilter support material constituting a biofilter bed and supporting a biofilm having microorganisms capable of oxidizing $H_2S$, the biofilm being arranged to be contacted with the $H_2S$ contaminated energy production gas stream and the microorganisms being arranged to remove at least part of the $H_2S$ of the $H_2S$ contaminated energy production gas stream, resulting in an $H_2S$ depleted energy production gas stream, wherein the aqueous biofilter system comprises means for adding an aqueous nitrate solution to the $H_2S$ contaminated energy production gas stream prior to being contacted with the microorganisms of the biofilm, enabling the microorganisms to oxidize the $H_2S$ under anoxic conditions.

In a preferred embodiment of an aqueous biofilter system according to the invention, the means for adding an aqueous nitrate solution to the $H_2S$ contaminated energy production gas stream comprise an atomizer nozzle adapted to atomize the nutrient solution into the energy production gas stream.

In the preferred embodiment according to the invention where part of the $H_2S$ depleted energy production gas stream is recirculated, and an atomizer nozzle is used to atomize the nutrient and/or the nitrate solution, this recirculation will ensure that the atomization of the nutrient and/or the nitrate solution into the energy production gas stream produces a very fine droplet size. Pure hydraulic injectors can for instance not provide such fine aerosols. In this way, because the nutrient and/or the nitrate solution are applied as fine droplets in the energy production gas stream, the nutrient and/or the nitrate solution will reach the microorganisms of the biofilm evenly. Also fouling and over-wetting of the biofilm is prevented in this way. In the known standard systems, solutions are not evenly sprayed over the biofilm since these solutions are only sprayed from a few points in the biofilter above the biofilter bed onto the biofilm.

In an advantageous embodiment of an aqueous biofilter system according to the invention, the biofilter system comprises a controller that is arranged to

- measure the $H_2S$ content in the $H_2S$ contaminated energy production gas stream present in the operational state of the biofilter system at the inlet of the biofilter,
- calculate the nutritional demand for the microorganisms, and
- adjust the nutritional dosage ratio of a carbon source, a nitrogen source and a phosphor source of the nutrient solution equalling to 100:10:1.

In one embodiment, the controller can be arranged to adapt simultaneously the dosage of the nitrogen and the phosphor source in the nutrient solution.

In another embodiment, the controller can be arranged to adapt the dosage of the nitrogen and the phosphor source in the nutrient solution separately.

The controller is preferably furthermore arranged to calculate a demand for recirculation of the part of the $H_2S$ depleted energy gas stream and to adjust the recirculation of the part of the $H_2S$ depleted energy gas stream in view of the demand of the nutrients solution.

The controller is also preferably further arranged to dose the nutrients solution automatically in function of the $H_2S$ content in the $H_2S$ contaminated energy gas stream that is measured at the inlet according to a relation between the $H_2S$-content in the energy gas stream, the nitrogen content and the phosphor content in the nutrient solution equalling to 20:10:1.

The aqueous biofilter system according to the invention is preferably arranged to perform a process according to the invention as described above.

According to another aspect of the invention, the use of an aqueous biofilter system according to the invention as described above for removing $H_2S$ from a $H_2S$ contaminated energy production gas stream containing methane is disclosed.

BRIEF DESCRIPTION OF THE FIGURES

FIG. 1 shows a scheme of the different parts of an exemplary embodiment of an aqueous biofilter system according to the invention.

DETAILED DESCRIPTION OF THE INVENTION

The process according to the invention for removing $H_2S$ from a $H_2S$ contaminated energy production gas stream containing methane, uses an aqueous biofilter system comprising a biofilter having biofilter support material constituting a biofilter bed which supports a humidified biofilm. This humidified biofilm has microorganisms that are capable of anoxically oxidizing $H_2S$.

It is herewith remarked that the exact type or configuration of the biofilter support material, neither the type of microorganisms, nor the exact type of biofilter support material, nor the configuration of the biofilter bed used is critical to this invention, as long as the biofilter is capable of oxidizing the $H_2S$ in the energy production gas stream under anoxic conditions, resulting in a $H_2S$ depleted energy production gas stream.

A variety of materials can be used as the biofilter support material including peat, compost material, soil, activated carbon, synthetic polymers, synthetic hydrogels and porous rocks. The biofilter support material may furthermore take a variety of forms such as cylindrical pellets, spheres, Raschig rings, irregular shapes, hollow tubes or fibers. The biofilter support material needs to be wettable with an aqueous solution and the surfaces of the support material are preferably porous. The support material must be such that microorganisms adhere thereto.

Humidification of the biofilm is necessary because the moisture content of the biofilm plays an important role in the $H_2S$ removal efficiency. It is common to use water to humidify the biofilm.

The process according to the invention comprises the steps of

- adding an aqueous nitrate solution to the $H_2S$ contaminated energy production gas stream;
- contacting the $H_2S$ contaminated energy production gas stream with the microorganisms of the humidified biofilm;
- anoxic oxidation of at least part of the $H_2S$ present in the $H_2S$ contaminated energy production gas stream by the microorganisms using the aqueous nitrate solution added to the $H_2S$ contaminated energy production gas stream prior to being contacted with the microorganisms of the biofilm. In this way, after the $H_2S$ contaminated energy production stream has passed through the biofilter system, a $H_2S$ depleted energy production gas stream is obtained, meaning an energy production gas stream out of which the major part of the $H_2S$ has been removed, preferably fulfilling the technical requirements of combustion engines as described above.

Any type of microorganisms, e.g. bacteria, can be used that are capable of oxidizing $H_2S$ present in the $H_2S$ contaminated energy production gas stream under anoxic conditions. Such standard and commonly used microorganisms in biofilter systems are known to the man skilled in the art and will not be listed and described in more detail here.

The biofilter bed can take on every shape that is known to the skilled person, such as a flat bed, trickle bed, column bed, tubular bed, etc.

The nitrate solution preferably comprises a calcium nitrate solution in order to allow the microorganisms to anoxically oxidize the $H_2S$. The concentration of the nitrate solution is preferably 45 weight % to 50 weight %.

In order to prevent clogging of inert precipitating agents and other substances formed through the anoxic oxidation of $H_2S$ by the microorganisms, the nitrate solution comprises a chelating agent. To prevent, for instance, calcium sulphate (gypsum) precipitation, ethylene diamine tetra acetic acid (EDTA) is usable to solubilize calcium sulphate and other substances that might precipitate during the process.

The nutrient solution for the microorganisms is preferably added to the energy production gas stream, this prior to being contacted with the microorganisms in the biofilm, through which the nutrients become available to the microorganisms at the moment the energy production gas stream including the nutrient solution passes over the biofilm. To that end, preferably part of the $H_2S$ depleted energy production gas stream is recirculated to the biofilter, together with the nutrient solution that is added thereto. Also the nitrate solution is preferably added to the recirculated part of the $H_2S$ depleted energy production gas stream. The nutrient and/or the nitrate solution, together with the recirculated part of the $H_2S$ depleted energy production gas stream, are preferably injected to the biofilter using an atomizer nozzle.

The nutritional dosage ratio of the nutrient solution is preferably automatically adjusted by measuring the content of the $H_2S$ in the $H_2S$ contaminated energy production gas stream at the inlet of the biofilter using a controller. The controller then calculates the nutritional demand for the microorganisms and adjusts the nutritional dosage ratio of a carbon (C) source, a nitrogen (N) source and a phosphor (P) source in the nutrient solution preferably according to the ratio 100:10:1. In order to optimize the working of the biofilter system, this ratio is preferably adjustable by means of the controller, resulting in a better performance of the biofilter system and a lower demand of chemicals.

The necessary demand of the nitrogen and the phosphor source in the nutrient solution with respect to the amount of $H_2S$ in the $H_2S$ contaminated energy production gas stream is preferably applied according to the relation $H_2S$:N:P=20:10:1. The controller can therewith be arranged to adapt the dosage of the nitrogen and the phosphor source in the nutrient solution simultaneously, but can also be arranged to adapt the dosage of the nitrogen and the phosphor source in the nutrient solution separately.

The invention is herewith illustrated with the scheme as shown in FIG. 1 which illustrates a non-limiting exemplary embodiment of an aqueous biofilter system (10) for removing $H_2S$ from a raw, $H_2S$ contaminated energy production gas stream containing methane according to the invention.

The untreated, raw $H_2S$ contaminated energy production gas stream (1) is injected by means of an atomizer nozzle (not shown on the figure) through a junction (9) into a biofilter (6). This biofilter (6) comprises a biofilter bed consisting of biofilter support material supporting a biofilm with microorganisms that are arranged to anoxically oxidize the $H_2S$ present in the $H_2S$ contaminated energy production stream (1) (as described above). At the end of the biofilter (6), a $H_2S$ depleted (cleaned) energy production stream is obtained. This $H_2S$ depleted energy production gas stream is passed through a splitter (11). The major part of this H2S depleted energy production gas stream is carried off to be used as energy production gas. A minor part of this $H_2S$ depleted energy production gas stream is recirculated to the biofilter (6) to be injected by the atomizer nozzle at the junction (9) in the biofilter (6) together with a nutrient solution and/or a nitrate solution that is used to anoxically oxidize the $H_2S$ in the $H_2S$ contaminated energy production gas stream.

The nutrient solution preferably is a N/P solution that is stored in a nutrient solution tank (12) and that is applied in a predetermined dose using a nutrient dosage pump (4). The recirculated $H_2S$ depleted energy production gas stream is brought from the splitter (11) to the injector (8) using a gas pump (7).

At (13), the temperature, $H_2S$ content, the flow and the pressure of the inflowing $H_2S$ contaminated energy production gas stream is measured. At (14), the temperature and the $H_2S$ content in the outflowing $H_2S$ depleted energy production gas stream is measured. As indicated by the dashed arrows (B) on FIG. 1, these measurements are sent to a controller (3). By monitoring the $H_2S$ content in the $H_2S$ contaminated energy production gas stream present in the operational state of the biofilter system at the inlet of the biofilter (6), the controller (3) is able to calculate the nutritional demand for the microorganisms of the biofilm, and adjust the nutritional dosage ratio of a carbon source, a nitrogen source and a phosphor source of the nutrient solution equalling to 100:10:1. By measuring the $H_2S$ content at the outlet of the biofilter (6), the nutritional dosage ratio can be further adjusted. As indicated in FIG. 1 with the dashed arrows (A), the controller (3) is thereto provided to control the gas pump (7) and the nutrient solution dosage pump (4).

Since the biofilter (6) will produce some surplus sludge, mostly consisting of sulphuric acid from the anoxic oxidation of $H_2S$, this sludge is removed from the biofilter (6) as effluent (5).

This biofilter system (10) achieves an efficiency of 99.5% in $H_2S$ removal from a $H_2S$ contaminated energy production gas stream.

The invention claimed is:

1. Process for removing $H_2S$ from a $H_2S$ contaminated energy production gas stream containing methane, using an aqueous biofilter system (10) comprising a biofilter (6) having biofilter support material constituting a biofilter bed supporting a humidified biofilm having microorganisms that are capable of oxidizing $H_2S$, wherein the process comprises the steps of adding an aqueous nitrate solution to the $H_2S$ contaminated energy production gas stream, prior to being contacted with the microorganisms;

contacting the $H_2S$ contaminated energy production gas stream including the aqueous nitrate solution with the microorganisms of the humidified biofilm, enabling the microorganisms to oxidize the $H_2S$ under anoxic conditions; and oxidation of at least part of the $H_2S$ in the $H_2S$ contaminated energy production gas stream by the microorganisms, using the aqueous nitrate solution added to the $H_2S$ contaminated energy production gas stream, prior to being contacted with the microorganisms, resulting in a $H_2S$ depleted energy production gas stream.

2. A process according to claim 1, wherein the nitrate solution comprises a chelating agent that is adapted to prevent clogging of inert precipitating agents and other substances formed through the anoxic oxidation of the $H_2S$ by the microorganisms.

3. A process according to claim 2, wherein for prevention of clogging of calcium sulphate precipitation, the chelating agent comprises ethylene diamine tetra acetic acid (EDTA).

4. A process according to claim 1, wherein the nitrate solution comprises a calcium nitrate solution to enable the microorganisms to oxidize the $H_2S$ under anoxic conditions.

5. A process according to claim 1, wherein the process comprises the step of recirculating part of the $H_2S$ depleted energy gas stream to the biofilter and adding to the recirculated energy production gas stream a nutrient solution prior to being contacted with the microorganisms of the biofilm.

6. A process according to claim 5, wherein the process comprises the step of automatically adjusting the dosage of the nutrient solution added to the $H_2S$ contaminated energy production gas stream in relation to the $H_2S$ content in the $H_2S$ contaminated energy production gas stream at an inlet of the biofilter system (10).

7. A process according to claim 5, wherein the process comprises the step of adding the nitrate solution to the part of the recirculated $H_2S$ depleted energy production gas stream prior to being contacted with the microorganisms of the biofilm.

8. A process according to claim 1, wherein the biofilm is humidified using the $H_2S$ contaminated energy production gas stream which has been pre-humidified before contacting the biofilm.

9. A process according to claim 1, wherein the aqueous nitrate solution and/or a nutrient solution is added to the $H_2S$ contaminated energy production gas stream (1) using an atomizer nozzle to atomize the aqueous nitrate and/or the nutrient solution.

10. A process according to claim 8, wherein the $H_2S$ contaminated energy production gas stream has been pre-humidified before contacting the biofilm by atomizing the aqueous nitrate solution and/or a nutrient solution into said $H_2S$ contaminated energy production gas stream, thus generating a $H_2S$ contaminated energy production gas stream including an aqueous nitrate solution and/or a nutrient solution as fine droplets.

11. Aqueous biofilter system (10) arranged to remove $H_2S$ from an energy production gas stream containing methane, the aqueous biofilter system (10) comprising a biofilter (6) having biofilter support material constituting a biofilter bed and supporting a biofilm having microorganisms capable of oxidizing $H_2S$, the biofilm being arranged to be contacted with the $H_2S$ contaminated energy production gas stream (1) including an aqueous nitrate solution and the microorganisms being arranged to remove at least part of the $H_2S$ out of the $H_2S$ contaminated energy production gas stream (1), resulting in a $H_2S$ depleted energy production gas stream (2), wherein the aqueous biofilter system (10) comprises means (4, 8) for adding an aqueous nitrate solution to the $H_2S$ contaminated energy production gas stream (9) before being contacted with the biofilm, enabling the microorganisms to oxidize the $H_2S$ under anoxic conditions.

12. Aqueous biofilter system (10) according to claim 11, wherein the means (8) for adding an aqueous nutrient solution to the $H_2S$ contaminated energy production gas stream (1) comprise an atomizer nozzle adapted to atomize the nutrient solution into the $H_2S$ contaminated energy production gas stream.

13. Aqueous biofilter system (10) according to claim 11, wherein the biofilter system (10) comprises a controller (3) that is arranged to measure the $H_2S$ content in the $H_2S$ contaminated energy production gas stream (1) present in the operational state of the biofilter system (10) at the inlet of the biofilter (6), calculate the nutritional demand for the microorganisms, and adjust the nutritional dosage ratio of a carbon source, a nitrogen source and a phosphor source of the nutrient solution equalling to 100:10:1.

14. Aqueous biofilter system (10) according to claim 11, wherein the controller (3) is arranged to adapt simultaneously the dosage of the nitrogen and the phosphor source in the nutrient solution.

15. Aqueous biofilter system (10) according to claim 11, wherein the controller (3) is arranged to adapt the dosage of the nitrogen and the phosphor source in the nutrient solution separately.

* * * * *